US006423366B2

(12) United States Patent
Falck et al.

(10) Patent No.: US 6,423,366 B2
(45) Date of Patent: Jul. 23, 2002

(54) STRIP COATING METHOD

(75) Inventors: Michael Falck, Wanatah; Norbert Satkoski, Union Mills, both of IN (US)

(73) Assignee: Roll Coater, Inc., Greenfield, IN (US)

( * ) Notice: Subject to any disclaimer, the term of this patent is extended or adjusted under 35 U.S.C. 154(b) by 0 days.

(21) Appl. No.: 09/785,947

(22) Filed: Feb. 16, 2001

Related U.S. Application Data

(60) Provisional application No. 60/183,605, filed on Feb. 16, 2000, and provisional application No. 60/255,255, filed on Dec. 13, 2000.

(51) Int. Cl.[7] ..... B05D 1/40

(52) U.S. Cl. ..... 427/8; 427/345; 427/422; 427/424; 427/429; 118/667; 118/673; 118/683; 118/684; 118/694

(58) Field of Search ..... 427/8, 345, 422, 427/424, 429; 118/667, 672, 673, 679, 683, 684, 688, 692, 693, 694, 695, 704

(56) References Cited

U.S. PATENT DOCUMENTS 4,535,722 A * 8/1985 Kondo ..... 118/692
4,604,300 A 8/1986 Keys et al. ..... 427/120
5,065,695 A * 11/1991 Baron et al. ..... 118/688
5,116,634 A * 5/1992 Havens et al. ..... 427/8
5,405,443 A * 4/1995 Akimoto et al. ..... 118/668
5,549,752 A 8/1996 Hahn et al. ..... 118/234
5,985,028 A 11/1999 Cornell et al. ..... 118/264
5,997,692 A * 12/1999 Taylor et al. ..... 162/175
6,013,312 A 1/2000 Cornell et al. ..... 427/210
6,190,727 B1 * 2/2001 Thaggard ..... 427/8

* cited by examiner

*Primary Examiner*—Shrive P. Beck
*Assistant Examiner*—Kirsten A. Crockford
(74) *Attorney, Agent, or Firm*—Barnes & Thornburg

(57) ABSTRACT

A method of applying a coating material to a moving strip of substrate comprising the steps of: (a) providing a supply signal from a controller to a coating supply unit to control the supply of coating material from the coating supply unit through a liquid usage detector and a liquid meter unit and to a coater for application to the moving strip; (b) providing a measure signal from the liquid usage detector to the controller to measure the flow rate of coating material through the liquid usage detector; (c) providing a delivery control signal from the controller to the liquid meter unit to control the amount of coating material delivered from the coater to the moving strip; (d) providing a heating signal from the controller to the inline heater to control the heating of coating material within the inline heater; and (e) providing a dispense signal from the controller to the coater to dispense coating material from the coater for application to the moving strip. In a preferred embodiment, the method desirably also includes the steps of detecting the position and width of the moving strip and providing a position/width signal to the controller to control the positioning of the dispensing of coating material by the coater head. The method also may include the step of recovering excess coating material dispensed from the coater.

46 Claims, 9 Drawing Sheets

96
PROCESS LINE CONTROLLER
94
114
16
47
ALARM
116
84
CONTROLLER
45
90
92
98
54
43
SUPPLY LEVEL SENSOR
BULK COATING MATERIAL
41
36
BULK SUPPLY PUMP
58
18
112
3-WAY VALVE
122
46
39
20
44
TRANSFER SUPPLY PUMP
SENSOR
120
118
38
32
GAGE TUBE
PURGE CLEAN-OUT VALVE
42
40
FILTER
HEATER
PLANT AIR

POSITION/WIDTH SENSOR
PRESSURE TRANSDUCER
INLINE HEATER
PROPORTIONAL VALVE
FILTER
VARIABLE SPEED DRIVE
FILTER
CENTRIFUGAL PUMP
MOTOR
10
22
24
26
30
48
50
52
53
56
59
64
66
68
74
76
78
79
81
84
88
90
92
98
99
100
110
111

STRIP COATING METHOD

This application claims the benefit of priority of U.S. provisional patent application serial No. 60/183,605, filed on Feb. 16, 2000 and U.S. provisional patent application serial No. 60/255,255, filed on Dec. 13, 2000.

BACKGROUND AND SUMMARY OF THE INVENTION

The present invention relates to a method of coating, and, more particularly, to a method of applying a coating material to a strip of metal or other substrate.

Currently, numerous methods exist for applying a coating or thin film of material to a strip of metal or other material. One conventional method of coating a continuous strip of substrates is to submerse the strip in a bath of the coating material. This can be accomplished by pulling the substrate through the bath of coating material, and then wiping off any excess coating material. This method has many drawbacks. One drawback to this method is the difficulty to control the amount of coating material applied to each side of the strip. Another drawback is the inability to apply different coating materials to each side of the strip. Also, this method often wastes a certain amount of the coating material during the wiping step.

Another known method of applying a coating or thin film of material to a strip of substrate is to employ a spray coater or atomizer. In such a method, the coating material is electrostatically disposed on the strip. A spray coater in accordance with this method is disclosed in U.S. Pat. No. 4,839,202.

Other known types of coating methods include passing the strip of substrate through various applicators which deposit a thin film onto the strip with or without electrostatic assistance. The applicators can be either stationary members or rotable members. One example of such a coating apparatus, which uses a pair of oppositely-disposed applicators, is disclosed in U.S. Pat. No. 5,549,752 to Hahn et al. The Hahn patent discloses passing a continuous strip of material between a pair of oppositely disposed applicators for applying a thin film thereto. In one embodiment, two stationary wicks directly contact the sides of the continuous strip of material to apply a coating to both sides of the sheet material. In another embodiment, the wicks apply the coating material to two feed rolls which contact the sides of the strip to apply a thin film of coating material thereto. One drawback to this type of coating apparatus is that it lacks the ability to adjust the amount of coating material being supplied to various sections of the applicators.

Other examples of prior coating apparatuses are disclosed in U.S. Pat. Nos.: 5,985,028 to Cornell et al.; 4,601,918 to Zaman et al; 4,604,300 to Keys et al.; 4,712,507 to Helling; and 4,995,934 to Janatka.

There is a need to improve upon the known coating methods to increase efficiency, accuracy, dependability and safety and to decrease costs and waste. Accordingly, it is an object of the present invention to provide a method of applying coating material to a strip of substrate that enables precision control and efficient operation thereof. It is a further object of the present invention to provide such a method that enables the application of coating to the strip in a high speed manner. It is a further object of the present invention to provide such a method that also eliminates or reduces waste.

These and other objects of the present invention are achieved by providing a method of applying a coating material to a moving strip of metal or other substrate comprising the steps of: (a) providing a signal from a controller to a coating supply unit to control the passage of coating material from the coating supply unit through a liquid usage detector and a liquid meter unit and to a coater, desirably at a constant pressure, for application to the moving strip; (b) providing a measure signal from the liquid usage detector to the controller to measure the flow rate of coating material through the liquid usage detector; (c) providing a delivery control signal from the controller to the liquid meter unit to control the amount of coating material delivered from the coater to the moving strip; and (d) providing a dispense signal from the controller to the coater to dispense coating material from the coater for application to the moving strip. In a preferred embodiment, the method desirably also includes the steps of detecting the position and width of the moving strip and providing a position/width signal to the controller to control the positioning of the dispensing of coating material by the coater. The method also may include the step of recovering excess coating material dispensed from the coater.

Other objects, advantages and novel features of the present invention will become apparent from the following detail description of the drawings when considered in conjunction with the accompanying drawings.

DETAILED DESCRIPTION OF THE DRAWINGS

Figure 1:
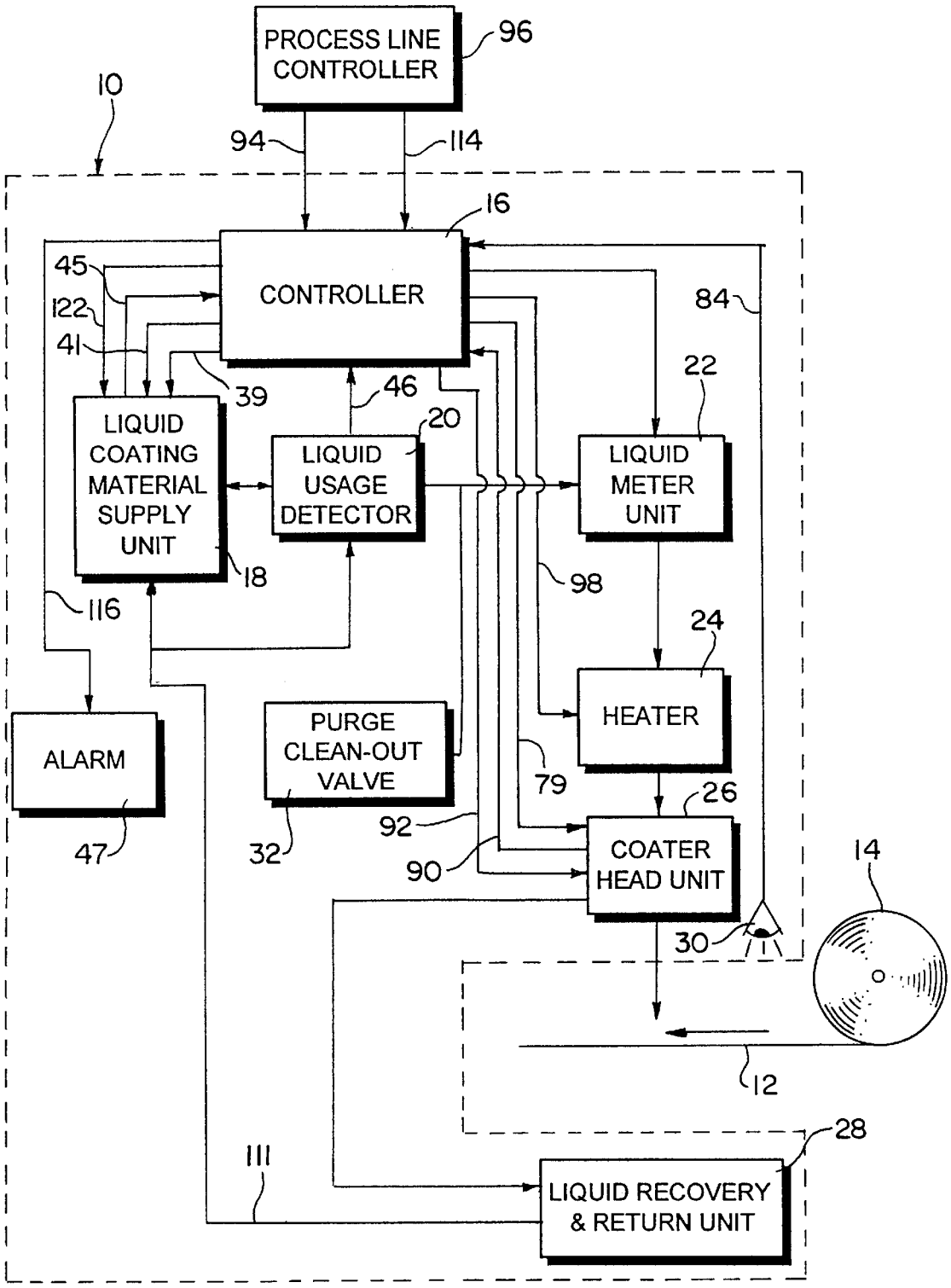
FIG. 1 is a diagrammatic view of a metal strip coating apparatus configured to apply a metered amount of a liquid coating material to a moving metal strip using a controller, a liquid coating supply unit, a liquid usage detector, a liquid meter unit, an inline heater, a coater head unit, and a liquid recovery and return unit.

A metal strip coating apparatus 10 is configured to apply a metered amount of liquid coating material to a high-speed moving strip 12 provided by a metal strip supply 14, as shown, for example, in FIG. 1. Metal strip coating apparatus 10 includes a controller 16, a liquid coating material supply unit 18, a liquid usage detector 20, a liquid meter unit 22, an inline heater 24, a coater in the form of a coater head unit 26, a liquid recovery and return unit 28, a position/width sensor 30, and a purge/clean-out valve 32, as shown, for example, in FIGS. 1 and 2.

Liquid coating material flows from supply unit 18 through liquid usage detector 20, purge/clean-out valve 32, liquid meter unit 22, and inline heater 24 to coater head unit 26. Coater head unit 26 is configured to apply liquid coating material directly onto moving metal strip 12. Liquid recovery and return unit 28 captures excess liquid coating material escaping from coater head unit 26 and returns the excess to either supply unit 18 or liquid usage detector 20 for reuse.

Controller 16 is a programmable logic controller dedicated to coating apparatus 10 and configured to control the application of liquid coating material onto moving metal strip 12 in a precise manner. Controller 16 uses process feedback information and adjusts process control outputs as required to apply liquid coating material accurately and efficiently with minimal waste and environmental contamination, as explained in more detail below.

In addition, controller 16 minimizes operator time and effort, permits changes in the mode of operation of coating apparatus 10 to be accomplished quickly and easily, and allows data-logging, monitoring, and alarm functions. In preferred embodiments, controller 16 is a stand-alone unit dedicated to coating apparatus 10 or one of the existing controllers for the process line. In addition, in preferred embodiments, controller 16 is a programmable logic controller supplied by Rockwell Automation located in Milwaukee, Wis.

Liquid supply unit 18 is coupled to controller 16 and is configured to supply filtered and heated liquid coating material to liquid usage detector 20 for application to moving metal strip 12. Liquid supply unit 18 includes a bulk supply pump 36, a liquid coating material supply container 38, a heater 40, a filter 42, a supply level sensor 43, and a transfer supply pump 44, as shown, for example, in FIG. 2.

Bulk supply pump 36 is configured to pump bulk liquid coating material to supply container 38. Supply heater 40 is positioned inside of supply container 38 and is coupled to controller 16 to receive a supply heater signal 41 therefrom to heat liquid coating material in supply container 38.

Supply level sensor 43 is mounted on a suction line of transfer supply pump 44 to detect the level of liquid coating material in supply container 38 and provide a supply level signal 45 to controller 16. Controller 16 instructs bulk supply pump 36 to turn on and off using a bulk supply pump signal 122 in response to supply level signal 45 to maintain a sufficient amount of liquid coating material in supply container 38. Supply level signal 45 can be used to alert an operator when supply container 38 needs to be replaced and to protect coating apparatus 10 if supply container 38 runs dry.

Transfer supply pump 44 is configured to supply filtered and heated liquid coating material from supply container 38 to liquid usage detector 20 in an intermittent fashion. Controller 16 is coupled to transfer supply pump 44 to send a transfer supply pump signal 39 thereto to control the operation of transfer supply pump 44 to instruct transfer supply pump 44 when to pump liquid coating material from supply container 38 to liquid usage detector 20. Transfer supply pump 44 is a positive displacement self-priming pump sized to the maximum coating material usage of coating apparatus 10. The pump suction line is a wand type with a flexible line connecting it to transfer supply pump 44 to permit easy changing of supply container 38. Filter 42 is positioned inside of supply container 38 and coupled to the suction line of transfer supply pump 44 to filter contamination from liquid coating material as it exits supply container 38.

Liquid usage detector 20 is configured to detect information indicative of the actual volumetric flow rate, or application rate, of liquid coating material flowing through coating apparatus 10. Liquid usage detector 20 provides a variable, analog usage signal 46 to controller 16, as shown, for example, in FIGS. 1 and 2, so that controller 16 can calculate the actual volumetric flow rate of liquid coating material to enable controller 16 to perform closed-loop feedback control of coating apparatus 10. The disclosure of U.S. patent application Ser. No. 60/223,745, filed on Aug. 8, 2000, is hereby incorporated by reference herein and discloses the structure and operation of liquid usage detector 20.

Figure 2:
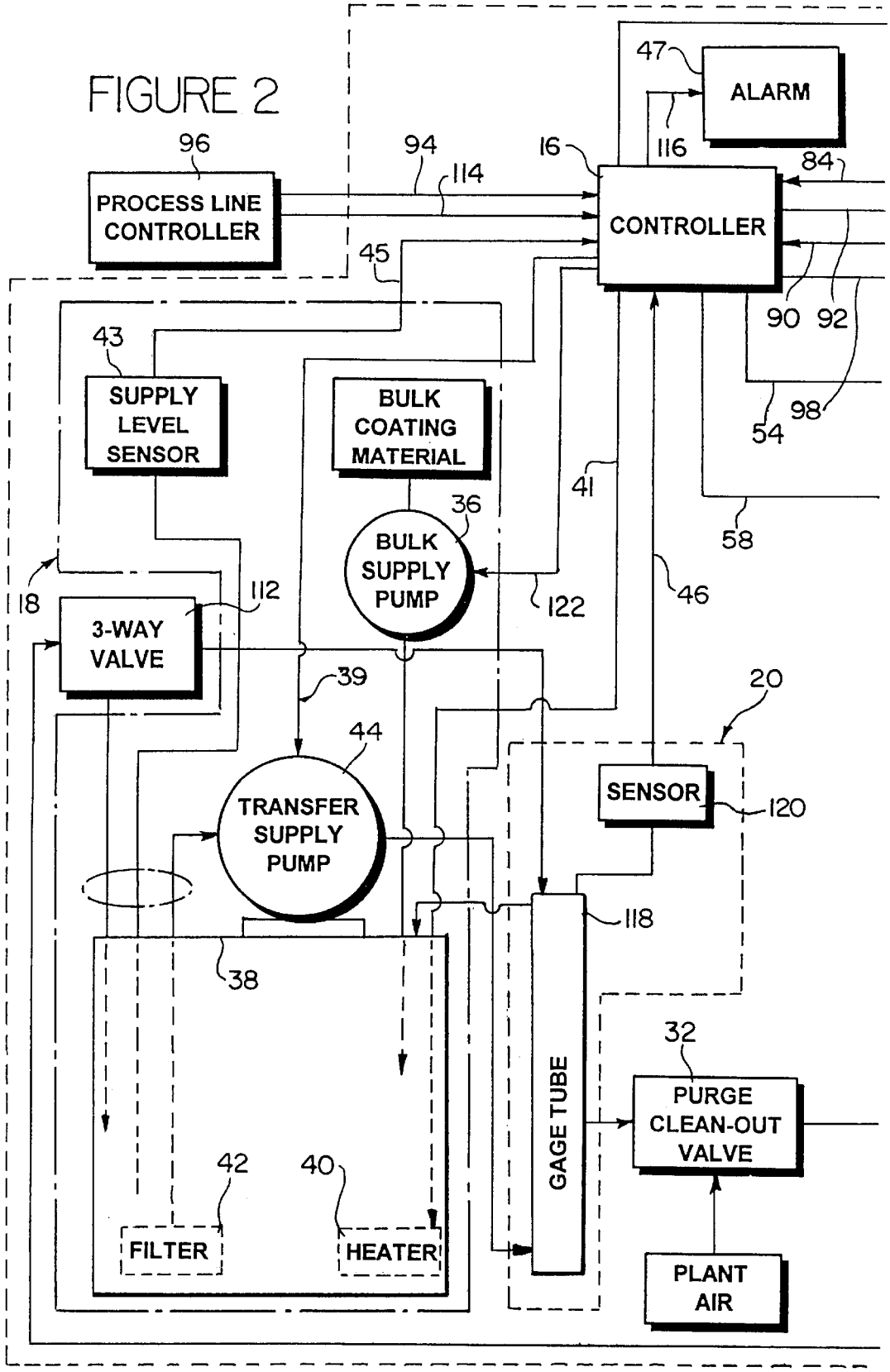
FIGS. 2 and 2*a* are a diagrammatic view of the coating apparatus of FIG. 1 showing components of the supply unit, the liquid usage detector, the liquid meter unit, and one of a pair of coater heads of the coater head unit.
Figure 2A:
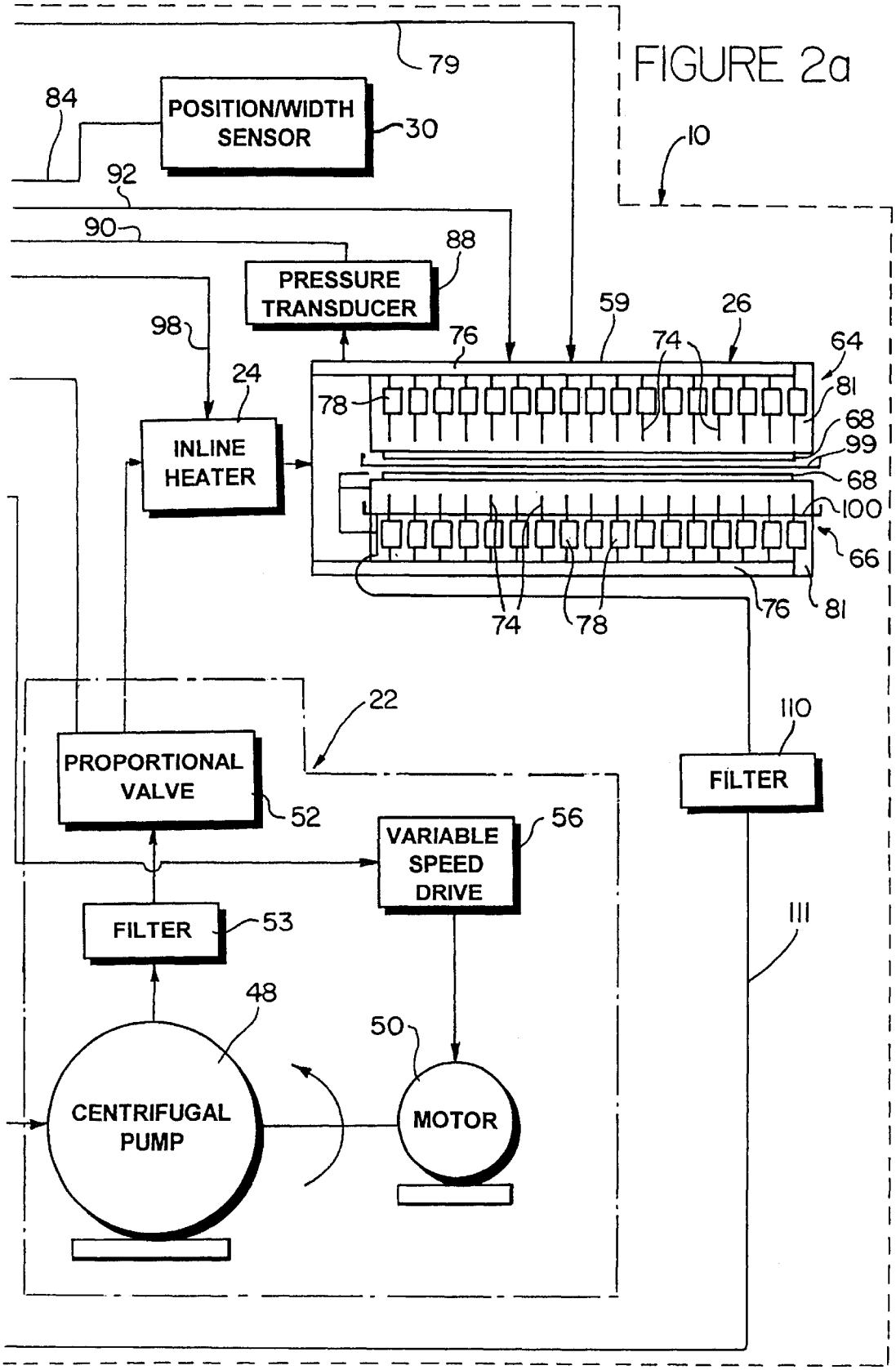
Figure 3:
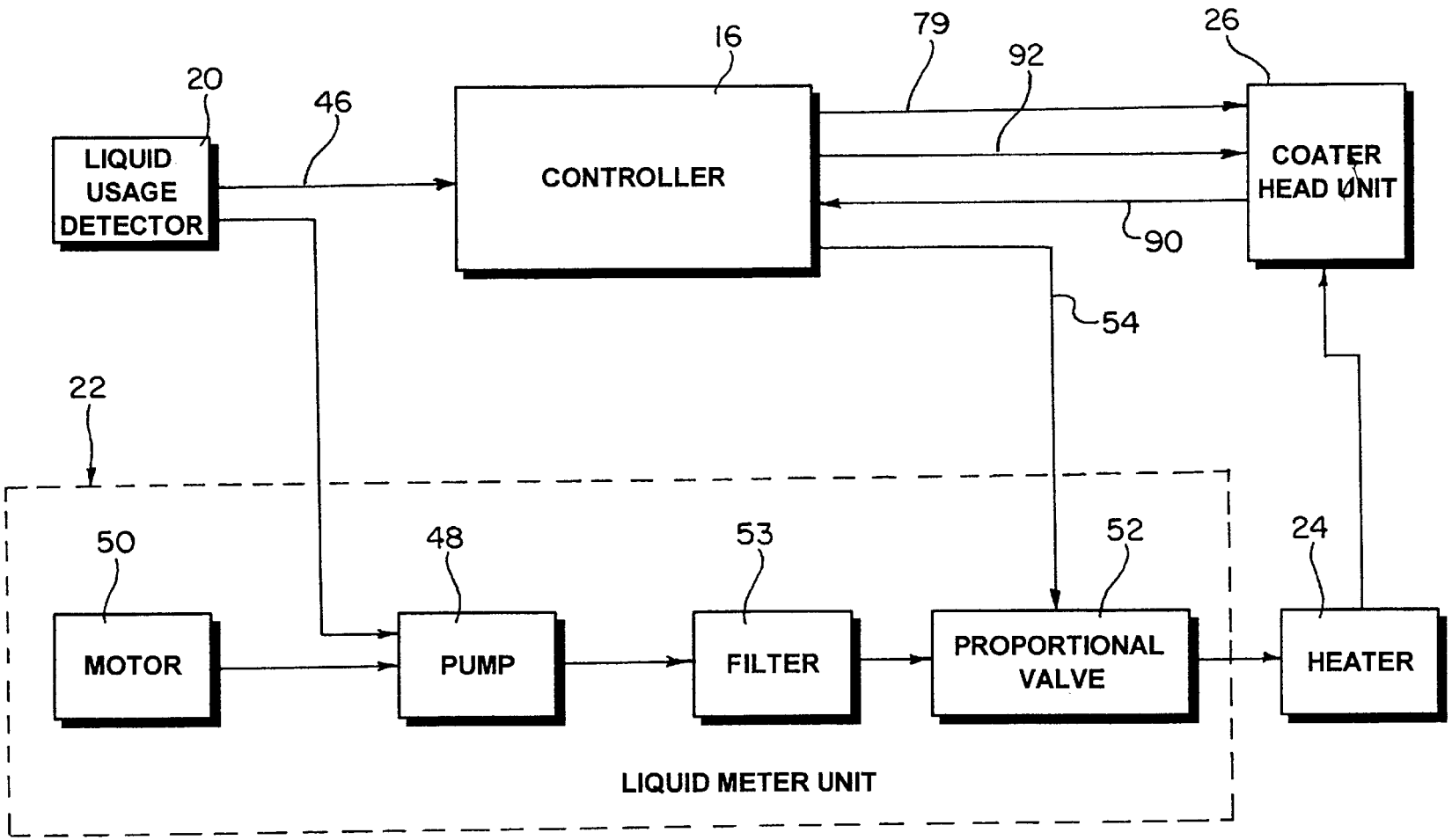
FIG. 3 is a diagrammatic view of the liquid meter unit showing the liquid meter unit including a centrifugal pump configured to deliver liquid coating material to the coater head unit, a motor coupled to the pump to drive the pump, and a proportional valve coupled to the controller and the pump to regulate the volume of liquid coating material delivered to the moving metal strip.

Liquid usage detector 20 includes a reservoir or gage tube 118 and a liquid level sensor 120, as shown, for example, in FIG. 2. Gage tube 118 is configured to contain liquid coating material so that the level of a horizontal, top surface of liquid coating material inside of gage tube 118 rises and falls in a generally cyclical manner in a sufficiently measurable way to enable controller 16 to calculate the actual volumetric rate of liquid coating material use. Gage tube 118 is coupled to liquid supply unit 18, purge/clean-out valve 32, and liquid recovery and return unit 28 for liquid communication.

Liquid level sensor 120 is mounted to gage tube 118 to measure the level of the top surface of liquid coating material in gage tube 118 as the level varies. Liquid level sensor 120 provides usage signal 46 which is indicative of the level of the top surface of liquid coating material. In preferred embodiments, liquid level sensor 120 is an analog Q45U ultrasonic proximity sensor obtained from Banner Engineering Corporation of Minneapolis, Minn. A laser-type proximity sensor is within the scope of this disclosure.

Coating apparatus 10 can include an alarm 47 coupled to controller 16, as shown, for example, in FIGS. 1 and 2. If so, controller would initiate alarm 47 using an alarm signal 116 to alert an operator when the actual volumetric flow rate of liquid coating material is outside of a predetermined range. For example, a leak could be indicated by an actual volumetric flow rate greater than expected.

Liquid meter unit 22 receives liquid coating material from liquid usage detector 20 and is coupled to controller 16 to control, or meter, the amount of liquid coating material delivered to moving metal strip 12 by coater head unit 16, as shown, for example, in FIGS. 1–5. Liquid meter unit 22 includes a single centrifugal pump 48, a motor 50 coupled to pump 48 to drive pump 48, a proportional valve 52 coupled to controller 16 and pump 48 for liquid communication with pump 48, and a filter 53, as shown, for example, in FIG. 3.

Pump 48 is sized to operate at the upper end of its performance curve to deliver liquid coating material to coater head unit 26 from liquid usage detector 20 at a constant pressure regardless of fluctuations in the demand for liquid coating material due, for example, to width changes in moving metal strip 12. Using single centrifugal pump 48 limits equipment and installation cost of coating apparatus 10, the complexity of coating apparatus 10, the amount of piping necessary for coating apparatus 10, the cost to maintain coating apparatus 10, and the potential for leaks of liquid coating material.

Controller 16 controls the position of proportional valve 52 by instructing proportional valve 52 using a proportional valve signal 54. Based on proportional valve signal 54 from controller 16, proportional valve 52 provides throttling control of centrifugal pump 48 to regulate the volume of liquid coating material delivered to moving metal strip 12 and the actual volumetric flow rate, or application rate, of liquid coating material. The criteria, or inputs, controller 16 uses to control proportional valve 52 is discussed in more detail below.

Figure 4:
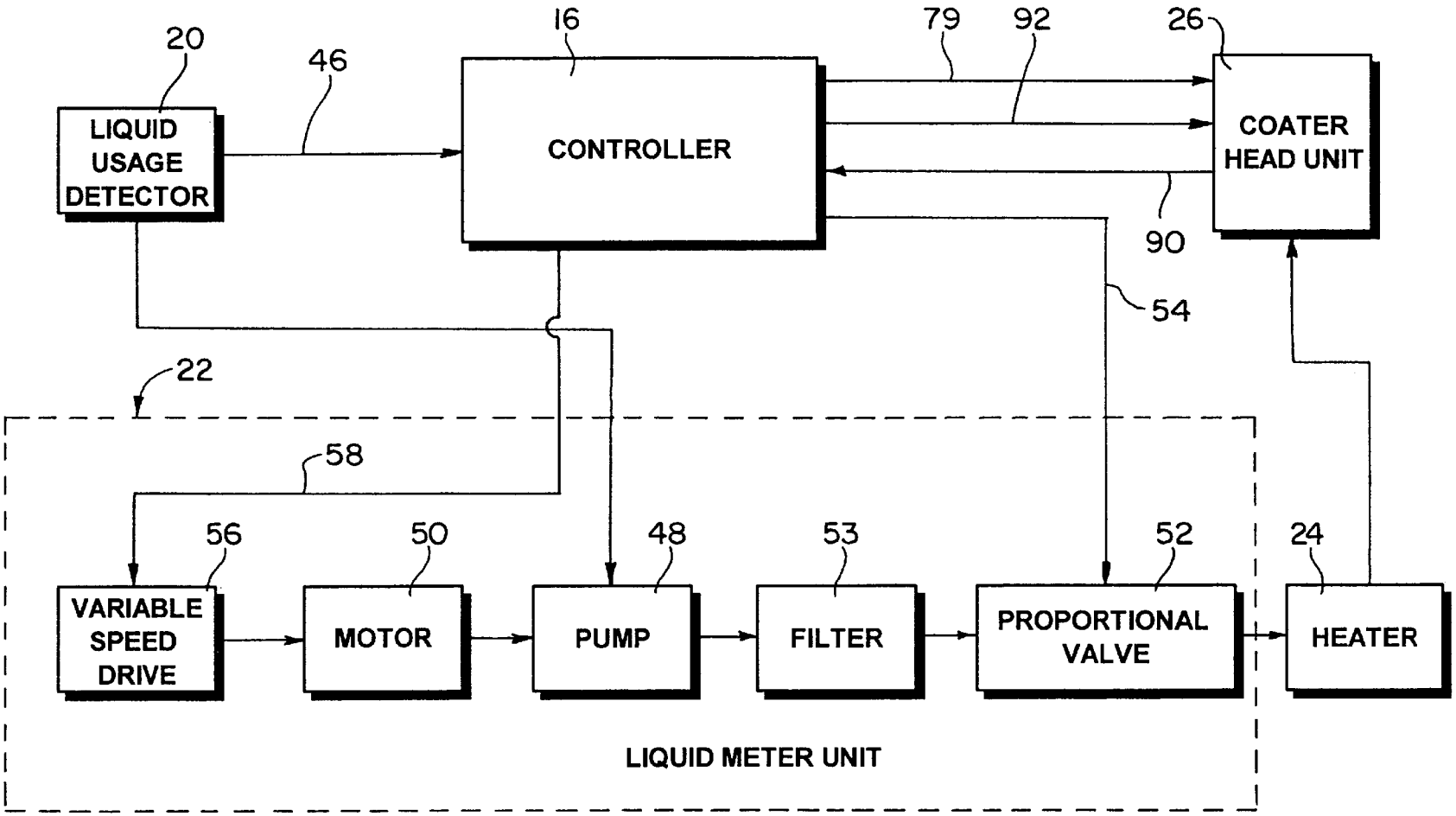
FIG. 4 is a diagrammatic view of an alternative embodiment of the liquid meter unit showing the liquid meter unit including the pump, the motor, the proportional valve, and a variable speed drive coupled to the controller and the motor to regulate the volume of liquid coating material delivered to the moving metal strip along with the proportional valve.
Figure 5:
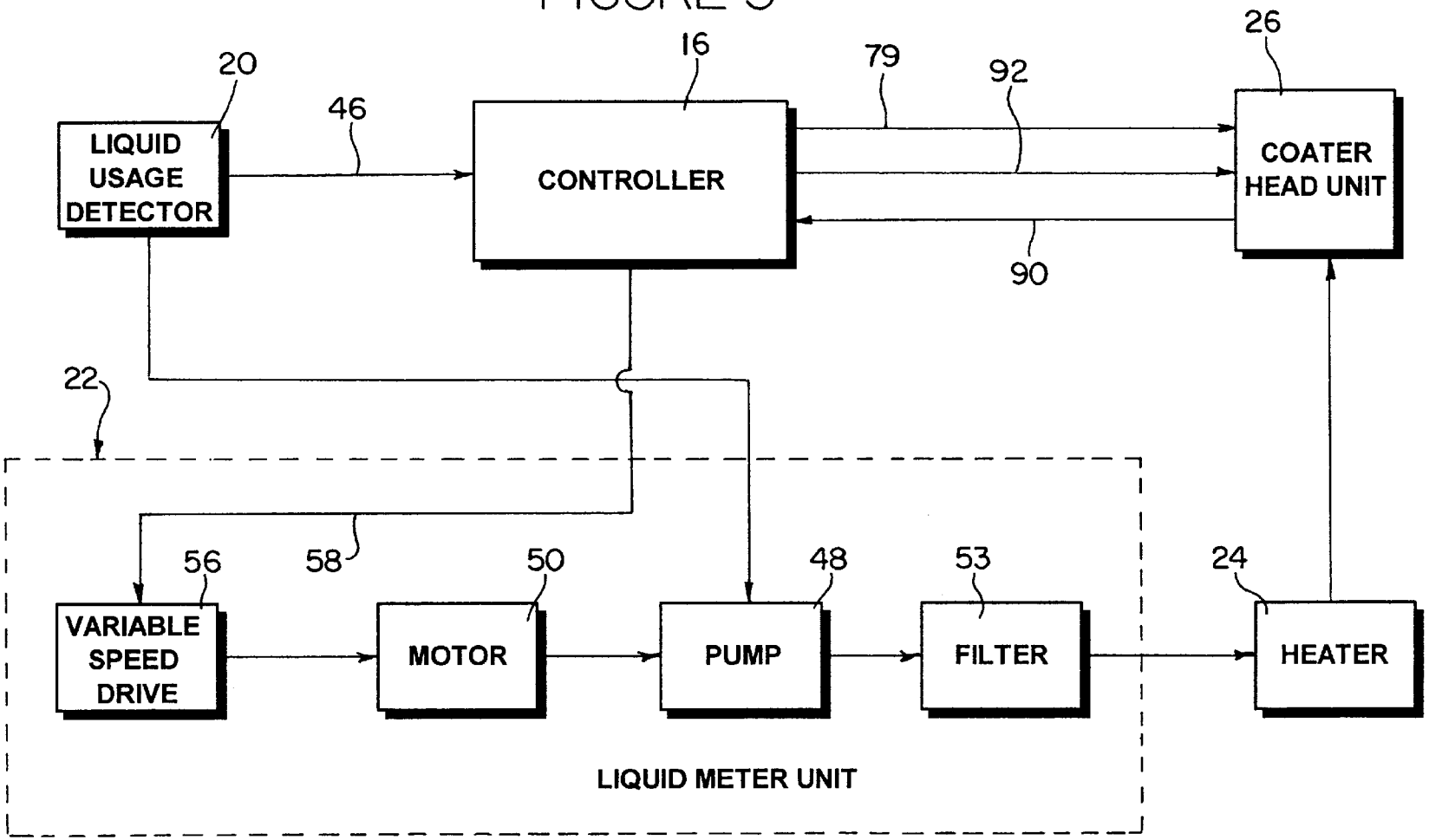
FIG. 5 is a diagrammatic view of yet another alternative embodiment of the liquid meter unit showing the liquid meter unit including the pump, the motor, and the variable speed drive without the proportional valve.

In preferred embodiments, liquid meter unit 22 includes a variable speed drive 56 in addition to or in place of proportional valve 52, as shown, for example, in FIGS. 4 and 5. Variable speed drive 56 is coupled to controller 16 and motor 50 to control centrifugal pump 48 by varying the speed of motor 50 to regulate the volume of liquid coating material delivered to moving metal strip 12 and the actual volumetric flow rate of liquid coating material along with, or in place of, proportional valve 52, as the case may be. Controller 16 controls variable speed drive 56 using a variable speed drive signal 58. The criteria, or inputs, controller 16 uses to control variable speed drive 56 is discussed in more detail below.

Liquid coating material flows through inline heater 24 after exiting liquid meter unit 22, as shown, for example, in FIGS. 1 and 2. Inline heater 44 is configured to heat liquid coating material (in addition to the heating provided by heater 40 of supply unit 18) to a predetermined temperature to facilitate "flash drying" of liquid coating material when it is applied to moving metal strip 12. Controller 16 is coupled to inline heater 24 and is configured to send an inline heater signal 98 to control the heating capacity of inline heater 24. Liquid coating material exiting inline heater 24 is piped to coater head unit 26 for application to moving metal strip 12.

Figure 6:
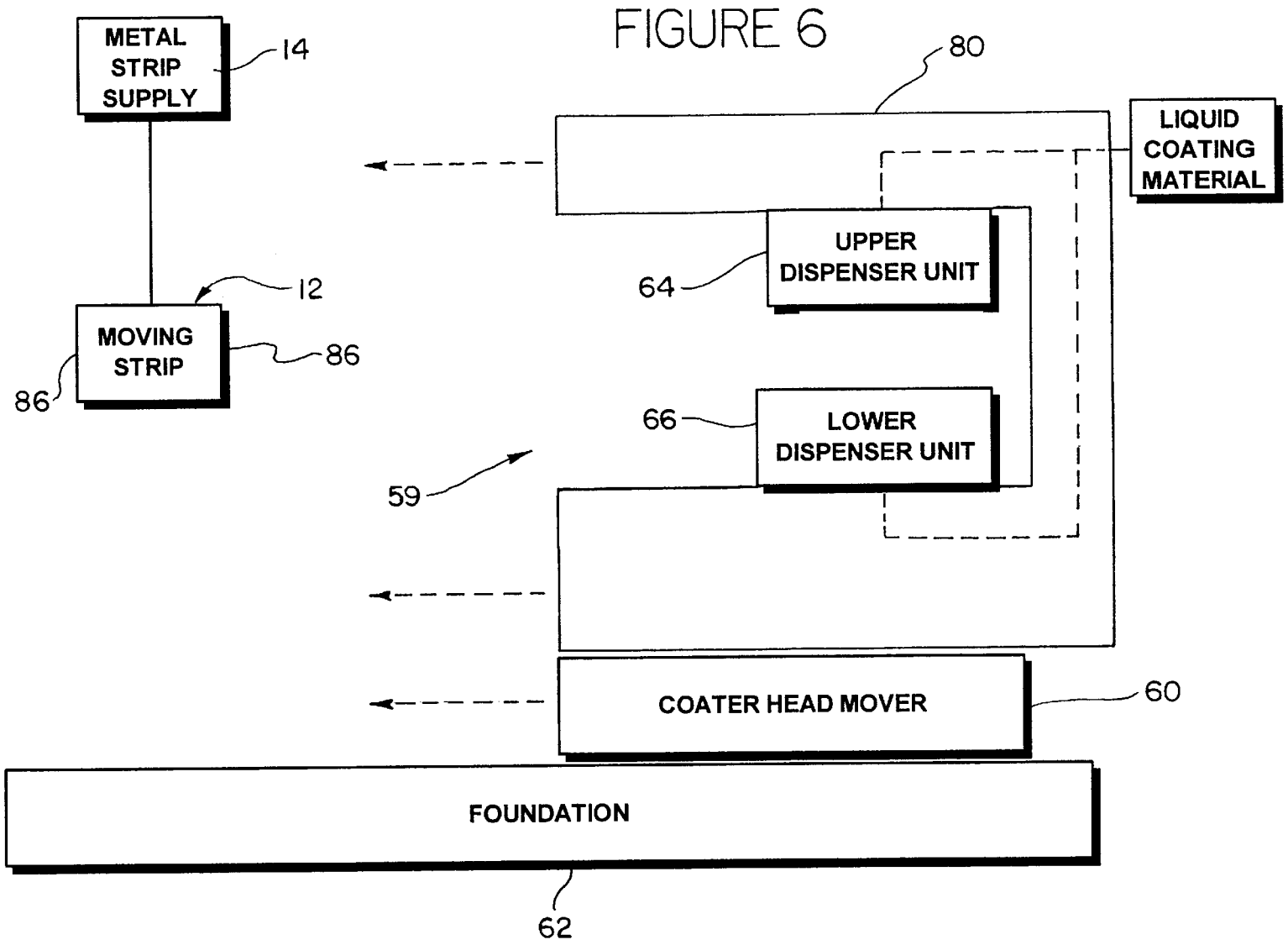
FIGS. 6 and 7 are diagrammatic views of one of the coater heads of the coater head unit showing the coater head being movable into and out of the process line of moving metal strip between an offline position, as shown in FIG. 6, and an online position, as shown in FIG. 7, the coater head including an upper dispenser unit for applying liquid coating material to the top of the moving metal strip and a lower dispenser unit for applying liquid coating material to the bottom of the moving metal strip.
Figure 7:
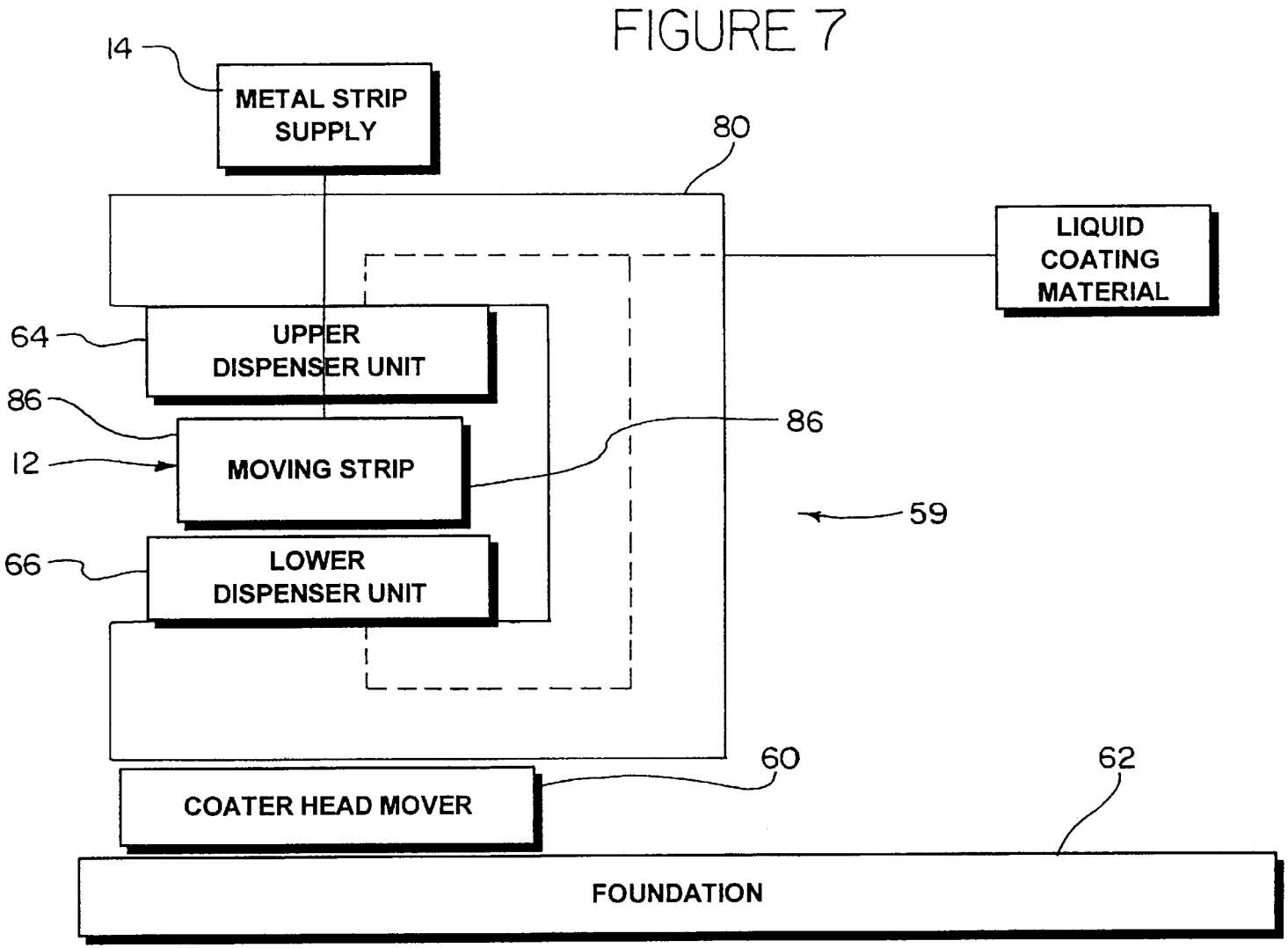

Coater head unit 26 includes a pair of coater heads 59 configured to shuttle into and out of the process line of moving metal strip 12, as shown, for example, in FIGS. 6 and 7 with respect to one of coater heads 59. Coater head unit 26 further includes a pair of coater head movers 60 to shuttle respective coater head 59 back and forth along a suitable foundation 62 between an offline position, as shown, for example, in FIG. 6, and an online position, as shown, for example, in FIG. 7. When one of coater heads 59 is disposed in the online position to coat moving metal strip 12, the other of coater heads 59 can be disposed in the offline position for servicing, for example, as production continues.

Each coater head 59 includes an upper dispenser unit 64 and a lower dispenser unit 66, as shown, for example, in FIGS. 2, 6, and 7. Each of dispenser units 64, 66 is configured to dispense liquid coating material received from inline heater 24 directly onto moving metal strip 12 using a felt coating discharger 68 made of felt material. In preferred embodiments, the felt material of felt coating discharger 68 is made of F1 hard white felt material available from McMaster-Carr Supply Company located in Chicago, Ill., although other grades of felt material may be suitable for other coating applications.

Figure 8:
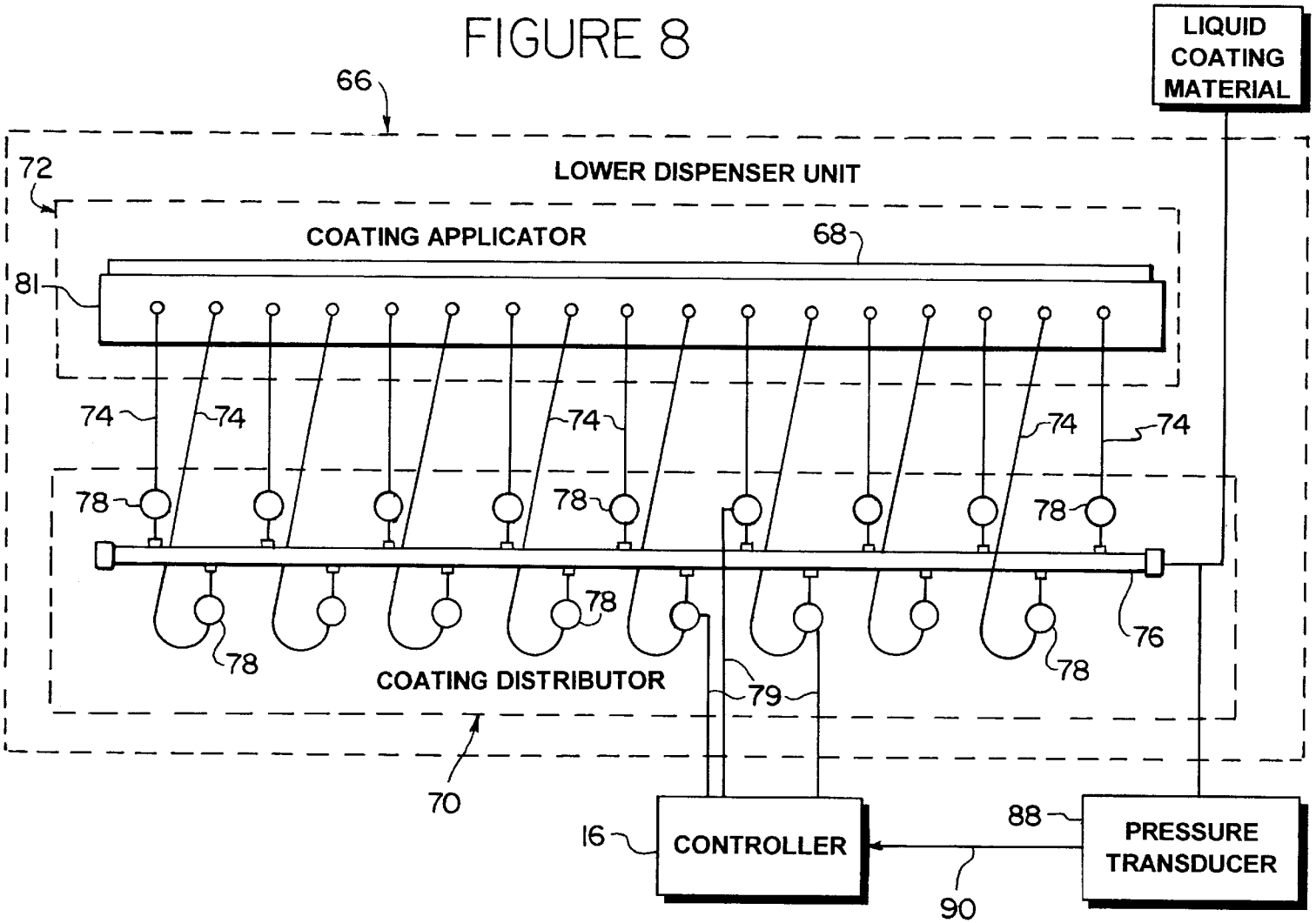
FIG. 8 is a diagrammatic view of the lower dispenser unit of FIGS. 2, 6, and 7 showing the lower dispenser unit including a coating applicator to apply liquid coating material onto the moving metal strip, a coating distributor to distribute liquid coating material to the coating applicator, and liquid-conducting conduits interconnecting the coating applicator and the coating distributor, the coating applicator including a felt coating discharger made of felt material and a felt holder, and the coating distributor including a manifold and a plurality of solenoid valves.

Each of dispenser units 64, 66 includes a coating distributor 70, a coating applicator 72, and a plurality of conduits 74 interconnecting coating distributor 70 and coating applicator 72, as shown, for example, in FIG. 8 with respect to lower dispenser unit 66. Coating distributor 70 is configured to distribute liquid coating material to conduits 74 which conduct liquid coating material to coating applicator 72.

Coating distributor 70 includes a manifold 76 and a plurality of solenoid valves. Manifold 76 is fixed to a C-shaped frame 80 of respective coater head 59 and conducts liquid coating material received from inline heater 24 to solenoid valves 78.

Coating applicator 72 includes felt coating discharger 68 and a felt holder 81 configured to hold felt coating discharger 68 in place. Coating applicator 72 is configured to move up and down relative to frame 80 and coating distributor 70 to permit insertion of moving metal strip 12 between felt coating dischargers 68 of respective coater head 59. Conduits 74 include a flexible portion to accommodate the movement of coating applicator 72 relative to coating distributor 70.

Controller 16 is coupled to solenoid valves 78 to open and close solenoid valves 78 individually by sending solenoid valve signals 79 to solenoid valves 78, as shown, for example, in FIG. 8. Opened solenoid valves 78 permit liquid coating material to flow into respective conduits 74 whereas closed solenoid valves 78 prohibit liquid coating material from flowing into respective conduits 74.

Controller 16 determines which solenoid valves 78 to open and close based upon the position and width of moving metal strip 12. Controller 16 determines the number and location of solenoid valves 78 turned on and off in response to a continuous analog position/width signal 84 from position/width sensor 30 of coating apparatus 10. Position/width sensor 30 is configured to detect the position and width of moving metal strip 12 and send position/width signal 84 indicative of the position and width of moving metal strip 12 to controller 16 in a continuous manner. In this way, controller 16 directs liquid coating material as required to coat moving metal strip 12 with minimal waste.

In general, controller 16 opens those solenoid valves 78 corresponding to the part of felt coating discharger 68 between edges 86 of moving metal strip 12 and closes those solenoid valves 78 corresponding to the part of felt coating discharger 68 outside of edges 86. Controller 16 also cycles solenoid valves 78 positioned near edges 86 on and off to modulate the flow of liquid coating material near edges 86 to prevent liquid coating material from running over edges 86 and to prevent build-up of liquid coating material at edges 86. Use of proportional solenoid valves (not shown) in place of solenoid valves 78 to gain finer control of the flow of liquid coating material without valve cycling at edges 86 of moving metal strip 12 is within the scope of this disclosure.

In preferred embodiments, position/width sensor 30 is a light screen system obtained from Banner Engineering Corporation of Minneapolis, Minn. Position/width sensor 30 generates a curtain of sensing beams of light to detect the position and width of moving metal strip 12. In other preferred embodiments, position/width sensor 30 is a steering unit used to track the position and width of moving metal strip 12 and move operational coater head 59 as required to maintain proper location with respect to moving metal strip 12.

Each coater head 59 further includes a pressure transducer 88, as shown, for example, in FIGS. 2 and 8. Pressure transducer 88 is coupled to a T-shaped coupling (not shown)

coupled to an inlet end of manifold 76 of lower dispenser unit 66 to measure the pressure of liquid coating material entering lower dispenser unit 66. Pressure transducer 88 provides a pressure signal 90 indicative of this pressure information to controller 16. Controller 16 uses this pressure information to determine whether the pressure of liquid coating material is acceptable and to regulate liquid meter unit 22 as required, as discussed in more detail below. In addition, controller 16 uses this pressure information to detect clogs in coating apparatus 10. Controller 16 includes self-test procedures which are based on cycling solenoid valves 78 on and off and monitoring an expected change in pressure.

Controller 16 sends a first splice jump signal 92 periodically to coater head 59 positioned in the process coating line in response to a second splice jump signal 94 from a process line controller 96, as shown, for example, in FIGS. 1 and 2. First splice jump signal 92 causes coater head 59 to open momentarily so that felt coating dischargers 68 of upper and lower dispenser units 64, 66 become spaced apart from moving metal strip 12 to "jump" splice joints (not shown) in moving metal strip 12. This avoids damage to felt coating dischargers 68 that could result from contact between felt coating dischargers 68 and the splice joints in moving metal strip 12.

Process line controller 96 is configured to control the entire coating line. In preferred embodiments, process line controller 96 is an Automax controller from Reliance Electric Controls located in Mayfield Heights, Ohio.

Liquid recovery and return unit 28 is configured to limit wastage of liquid coating material by recovering excess liquid coating material from dispenser units 64, 66 and returning liquid coating material for reuse by coating apparatus 10. Liquid recovery and return unit 28 includes upper and lower drain receptacles 99, 100, a filter 110, a return conduit 111, and a three-way valve 112, as shown, for example, in FIG. 2.

Upper drain receptacle 99 is coupled to frame 80 and felt holder 81 of upper dispenser unit 64 through a linkage system (not shown). Upper drain receptacle is rotatable between a use position and a storage position. In the use position, upper drain receptacle 99 is positioned under felt coating discharger 68 of upper dispenser unit 64 and above moving metal strip 12 to catch liquid coating material dripping from coating applicator 72 of upper dispenser unit 64 when coater head 59 is opened. In the storage position, upper drain receptacle 99 is positioned out from under felt coating discharger 68 of upper dispenser unit 64 to permit felt coating discharger 68 to contact moving metal strip 12 when coater head 59 is closed.

Lower drain receptacle 100 is fixed to felt holder 81 of coating applicator 72 of lower dispenser unit 66. Lower drain receptacle 100 surrounds felt holder 81 and is positioned below at least a portion of felt coating discharger 68 of lower dispenser unit 66 and moving metal strip 12 to catch excess liquid coating material from felt coating discharger 68 of lower dispenser unit 66.

Upper and lower drain receptacles 99, 100 include apertures (not shown) to drain excess liquid coating material therefrom. Excess liquid coating material passes through a filter 110 and 3-way valve 112. The configuration of valve 112 determines whether excess liquid coating material is deposited into supply container 38 or liquid usage detector 20 for reuse. Valve 112 directs excess liquid coating material to supply container 38 during purging of coating apparatus 10 for cleaning, for example, and directs excess liquid coating material to liquid usage detector 20 during normal operation of coating apparatus 10.

Controller 16 is configured to determine whether to direct a clean-out of the lines of coating apparatus 10 based on usage signal 46 from liquid usage detector 20 or operator-initiated input. To purge liquid coating material from the lines of coating apparatus 10, the suction wand from transfer supply pump 44 is removed from supply container 38. Three-way valve 112 is set to direct liquid coating material to supply container 38. Controller 16 then operates transfer supply pump 44 and centrifugal pump 48 until there is no liquid coating material in gage tube 118 and the lines up to centrifugal pump 48. Purge/clean-out valve 32 is closed to prevent air from going back through liquid usage detector 20 and plant air is used to force the remaining liquid coating material through coater heads 59 into liquid recovery and return unit 28 for return to supply container 38 for reuse.

To restart coating apparatus 10 with new liquid coating material, purge/clean-out valve 32 is configured in its operating position. The suction wand of transfer supply pump 44 is inserted into supply container 38 and transfer supply pump 44 is started. When liquid coating material reaches the appropriate level in liquid usage detector 20, centrifugal pump 48 is started and run until air is purged from the lines and liquid coating material is flowing through felt coating dischargers 68. Three-way valve 112 is set to return liquid coating material to gage tube 118 and coating apparatus 10 is ready to run.

Controller 16 uses usage signal 46 along with a line speed signal 114 indicative of the speed of moving metal strip 12 and position/width signal 84 indicative of the width of moving metal strip 12 to determine the coating weight of liquid coating material applied to moving metal strip 12. This information is then recorded for future reference and used to alert operators of any problems in this regard. For example, if controller 16 determines the coating weight is too low, operators could be alerted by alarm 47 to check liquid coating material on moving metal strip. If liquid coating material use is too high, a leak could be indicated and alarm 47 initiated. Process line controller 96 provides line speed signal 114 to controller 16.

Controller 16 receives line speed signal 114 from process line controller 96, as shown, for example, in FIG. 1 and 2. Line speed signal 114 is indicative of the speed of moving metal strip 12. Controller 16 uses line speed signal 114 to change the rate at which liquid coating material is applied to moving metal strip 12 as required to maintain consistent application of liquid coating material thereto, as discussed in more detail below.

Controller 16 controls the amount and rate of liquid coating material delivered to moving metal strip 12 by controlling the position of proportional valve 52 and/or by controlling variable speed drive 56. When proportional valve 52 is used in liquid meter unit 22, as shown, for example, in FIGS. 3 and 4, controller 16 controls the position of proportional valve 52 using proportional valve signal 54. Proportional valve signal 54 is based on usage signal 46 from liquid usage detector 20, pressure signal 90 from pressure transducer 88, line speed signal 114 from process line controller 96, position/width signal 84 from position/width sensor 30 and indicative of the width of moving metal strip 12, and the desired coating weight on moving metal strip 12 provided by an operator. When variable speed drive 56 is used, as shown, for example, in FIGS. 4 and 5, controller 16 controls variable speed drive 56 using variable speed drive signal 58 based on these same inputs discussed in connection with the control of proportional valve 52.

Coating apparatus 10 includes a computerized operator interface (not shown). The operator interface is keyboard- or pushbutton- selectable. The operator interface includes a menu system so that controller 16 automatically sets parameters of coating apparatus 10 when an operator selects a product to be run. In addition, the menu system permits the operator to select other functions such as clean-out of the lines of coating apparatus 10, changes in the mode of operation of coating apparatus 10, data-logging to record desired information about each run, self-test diagnostics, and resetting of alarm 47.

Although the invention has been described and illustrated in detail with reference to preferred embodiments, it is to be clearly understood that the same is by way of illustration and example only, and is not to be taken by way of limitation. The spirit and scope of the present invention are to be limited only by terms of the appended claims.

What is claimed is:

1. A method of applying a coating material to a moving strip of substrate comprising the steps of:

(a) providing a supply signal from a controller to a coating supply unit to control the passage of coating material from the coating supply unit through a liquid usage detector and a liquid meter unit to a coater for application to the moving strip;

(b) providing a measure signal from the liquid usage detector to the controller to measure the flow rate of coating material passing through the liquid usage detector;

(c) providing a delivery control signal from the controller to the liquid meter unit to control the amount of coating material delivered from the coater to the moving strip; and (d) providing a dispense signal from the controller to the coater to dispense coating material from the coater for application to the moving strip.

2. The method of claim 1 wherein during step (a) coating material passes from the coating supply unit in an intermittent manner.

3. The method of claim 1 wherein the coating supply unit includes a supply container and a supply heater and the method further includes the step of providing a supply heater signal to heat liquid coating material in the supply container.

4. The method of claim 1 wherein during step (a) the supply signal is provided in response to a supply level signal from the coating supply unit to the controller.

5. The method of claim 4 wherein the coating supply unit includes a supply container and a supply level sensor for detecting the level of coating material in the supply container and for providing the supply level signal to the controller.

6. The method of claim 4 wherein the coating supply unit includes a supply pump having an off position and an on position for supplying coating material from the coating supply unit to the liquid usage detector during step (a) and wherein during step (a) the supply pump switches to one of the off position and the on position in response to the supply signal.

7. The method of claim 1 wherein step (a) includes maintaining a predetermined amount of coating material in the coating supply unit.

8. The method of claim 1 wherein during step (a) coating material is provided to the coater at a constant pressure.

9. The method of claim 8 wherein the liquid meter unit includes a centrifugal pump for providing coating material to the coater at the constant pressure.

10. The method claim 1 wherein during step (b) the liquid usage detector detects information indicative of the flow rate of coating material through the liquid usage detector.

11. The method of claim 1 wherein the measure signal includes a variable analog usage signal.

12. The method of claim 1 wherein the liquid usage detector includes a gage tube containing coating material and a liquid level sensor and during step (b) the liquid level sensor measures the level of the coating material in the gage tube and provides to the controller a usage signal indicative of the level.

13. The method of claim 1 wherein step (b) includes providing an alarm signal from the controller to an alarm when the flow rate is outside a predetermined range.

14. The method of claim 1 wherein the liquid meter unit includes a pump, a motor coupled to the pump, a proportional valve coupled to the controller and the pump, and a filter for controlling the amount of coating material delivered from the coater to the moving strip.

15. The method of claim 1 wherein the liquid meter unit includes a valve coupled to the controller for providing a valve signal from the controller to the valve during step (c).

16. The method of claim 15 wherein the liquid meter unit further includes a pump, the valve being coupled to the pump and the controller.

17. The method of claim 1 wherein the liquid meter unit includes a pump and a variable speed drive coupled to the pump and the controller, and wherein during step (c) the controller provides a variable speed drive signal to the variable speed drive for controlling the pump.

18. The method of claim 1 wherein the coater includes at least one solenoid valve coupled to the controller and step (c) includes providing a solenoid signal from the controller to the solenoid valve to control the opening and closing of the solenoid valve.

19. The method of claim 1 wherein the coating head includes a plurality of solenoid valves coupled to the controller and step (c) includes providing a solenoid valve signal from the controller to the plurality of solenoid valves to control the opening and closing of the solenoid valves.

20. The method of claim 19 wherein during step (c) some of the solenoid valves open and some of the solenoid valves close in response to the solenoid valve signal.

21. The method of claim 1 further including the steps of detecting the position and width of the moving strip and providing a position/width signal to the controller to control the positioning of the dispensing of coating material during step (c).

22. The method of claim 21 wherein the coater unit includes a plurality of solenoid valves and providing the position/width signal controls the opening and closing of the solenoid valves during step (c).

23. The method of claim 22 wherein during step (c) some of the solenoid valves open and some of the solenoid valves close in response to the position/width signal.

24. The method of claim 21 wherein the detecting step includes detecting the position and width of the moving strip with a position/width sensor.

25. The method of claim 24 wherein the position width sensor is a light screen system.

26. The method of claim 1 further including the step of recovering excess coating material dispensed from the coater during step (d).

27. The method of claim 26 wherein the excess coating material is received by a liquid recovery and return unit during the recovery step.

28. The method of claim 26 wherein the recovering step includes delivering some of the excess coating material to the coating supply unit and delivering some of the excess coating material to the liquid usage detector.

29. The method of claim 26 wherein the liquid recovery and return includes a valve and during the recovery step the valve is adapted to deliver some of the excess coating material to the coating supply unit for cleaning and some of the excess coating material to the liquid usage detector for reuse.

30. The method of claim 1 further including the step of cleaning out lines of passage through which coating material passes during step (a).

31. The method of claim 30 wherein the controller provides a usage signal during the cleaning-out step.

32. The method of claim 1 further including the step of regulating the pressure of coating material dispensed from the coater during step (d).

33. The method of claim 32 wherein the coater includes a pressure transducer for regulating the pressure of coating material dispensed from the coater during step (d).

34. The method of claim 1 wherein during step (a) coating material also passes through an inline heater before being supplied to the coater and further comprising the step of providing a heating signal from the controller to the inline heater to control the heating of coating material within the inline heater.

35. A method of applying a coating material to a moving strip of substrate comprising the steps of:

(a) providing a supply signal from a controller to a coating supply unit to control the passage of coating material from the coating supply unit through a liquid usage detector and a liquid meter unit to a coater for application to the moving strip at a constant pressure;

(b) providing a measure signal from the liquid usage detector to the controller to measure the flow rate of coating material passing through the liquid usage detector;

(c) providing a delivery control signal from the controller to the liquid meter unit to control the amount of coating material delivered from the coater to the moving strip;

(d) detecting the position and width of the moving strip and providing a position/width signal to the controller to control the positioning of the dispensing of coating material by the coater;

(e) providing a dispense signal from the controller to the coater to dispense coating material from the coater for application to the moving strip; and (f) recovering excess coating material dispensed from the coater.

36. The method of claim 35 wherein the coating supply unit includes a supply container and a supply level sensor for detecting the level of coating material in the supply container and wherein during step (a) the supply signal is provided in response to a supply level signal from the supply level sensor to the controller.

37. The method of claim 36 wherein step (a) includes maintaining a predetermined amount of coating material in the supply container.

38. The method of claim 35 wherein the liquid usage detector includes a gage tube containing coating material and a liquid level sensor and during step (b) the liquid level sensor measures the level of the coating material in the gage tube and provides to the controller a usage signal indicative of the level.

39. The method of claim 35 wherein the liquid meter unit includes a pump, a valve being coupled to the pump and the controller, and wherein during step (c) the controller provides a valve signal to the valve.

40. The method of claim 35 wherein the liquid meter unit includes a pump and a variable speed drive coupled to the pump and the controller, and wherein during step (c) the controller provides a variable speed drive signal to the variable speed drive for controlling the pump.

41. The method of claim 35 wherein the coater includes a plurality of solenoid valves coupled to the controller and step (d) includes providing a solenoid valve signal from the controller to the plurality of solenoid valves to control the opening and closing of the solenoid valves.

42. The method of claim 41 wherein during step (d) some of the solenoid valves open and some of the solenoid valves close in response to the solenoid valve signal.

43. The method of claim 35 wherein step (f) includes delivering some of the excess coating material to the coating supply unit and delivering some of the excess coating material to the liquid usage detector.

44. The method of claim 35 wherein the coater includes a pressure transducer for sensing the pressure of coating material dispensed from the coater during step (e).

45. The method of claim 35 wherein during step (a) supply also passes through an inline heater before being supplied to the coater and further comprising the step of providing a heating signal from the controller to the inline heater to control the heating of coating material within the inline heater.

46. A method of applying a coating material to a moving strip of substrate comprising the steps of:

(a) providing a supply level signal from a supply level sensor of a coating supply unit to a controller, the supply level signal being indicative of the level of supply of coating material within a supply container of the coating supply unit;

(b) providing a supply signal from the controller to the supply container of the coating supply unit to control the passage of coating material from the supply container through a gage tube of a liquid usage detector, an inline heater and a liquid meter unit to a coater for application to the moving strip at a constant pressure;

(c) providing a measure signal from a liquid level sensor of the liquid usage detector to the controller to measure the flow rate of coating material passing through the gage tube of the liquid usage detector;

(d) providing a heat signal from the controller to the inline heater to control the heating of coating material within the inline heater;

(e) providing a delivery control signal from the controller to the liquid meter unit to control the amount of coating material delivered from the coater to the moving strip;

(f) detecting the position and width of the moving strip with a position/width sensor and providing a position/width signal to the controller;

(g) providing a valve signal from the controller to a plurality of solenoid valves of the coater to control the positioning of the dispensing of coating material by the coater by controlling the opening and closing of the solenoid valves of the coater;

(h) providing a dispense signal from the controller to the coater to dispense coating material from the coater for application to the moving strip; and (i) recovering excess coating material dispensed from the coater, the recovering step includes delivering some of the excess coating material to the coating supply unit and delivering some of the excess coating material to the liquid usage detector.

* * * * *